United States Patent [19]

Etoh

[11] 4,271,780

[45] Jun. 9, 1981

[54] APPARATUS FOR MANEUVERING A SHIP

[75] Inventor: Akio Etoh, Kawasaki, Japan

[73] Assignee: Niigata Engineering Co., Ltd., Tokyo, Japan

[21] Appl. No.: 22,140

[22] Filed: Mar. 20, 1979

[30] Foreign Application Priority Data

Dec. 6, 1978 [JP] Japan ..... 53-168279[U]

[51] Int. Cl.[3] ..... B63H 25/00

[52] U.S. Cl. ..... 114/144 E

[58] Field of Search ..... 114/144 R, 144 E; 74/471 R, 471 XY, 491, 504; 244/83 R, 83 B, 83 E; 318/588

[56] References Cited

U.S. PATENT DOCUMENTS

| | | | |
|---|---|---|---|
| 3,976,023 | 8/1976 | Noguchi et al. | 114/144 E |
| 4,088,087 | 5/1978 | Nitta | 114/144 R |

FOREIGN PATENT DOCUMENTS

| | | | |
|---|---|---|---|
| 52-13284 | 1/1977 | Japan | 114/144 R |

*Primary Examiner*—Trygve M. Blix
*Assistant Examiner*—Jesús D. Sotelo
*Attorney, Agent, or Firm*—Sughrue, Rothwell, Mion, Zinn and Macpeak

[57] ABSTRACT

Apparatus for maneuvering a ship having Z-type propeller structure. A maneuvering handle provides a proportional relationship of ship speed and ship direction with its inclination angle and rotation direction respectively. A generally cylindrical rotation frame is rotatably supported by a stationary frame, a rotation shaft is disposed along the diametrical direction of the rotation frame, and a maneuvering handle is positioned at the approximately central portion of the rotation shaft. The lower end of the maneuvering handle is connected to the rotation shaft. The rotation shaft is rotated about its axis by the pivotal movement of the handle. Furthermore, a hollow shaft is rotatably disposed coaxial with the rotation frame. The hollow shaft is provided with first and second central gears. A central shaft rotatably disposed in the hollow shaft has one end provided with an ahead-astern changing gear and the other end provided with an arm member. The central shaft further provides a loose gear and a bevel gear both being freely rotatably thereabout, and the arm member rotatably supports an intermediate shaft having one end provided with a first intermediate gear and the other end provided with a second intermediate gear. The loose gear is in meshing engagement with the first intermediate gear and the second central gear is meshed with the second intermediate gear.

14 Claims, 10 Drawing Figures

APPARATUS FOR MANEUVERING A SHIP

BACKGROUND OF THE INVENTION

1. Field of the Invention

This invention relates to an apparatus for maneuvering a ship, and more particularly, to a type thereof which realizes the control of the direction of the trailing flow of the propellers of a Z-type propelling means by a single maneuvering handle.

2. Description of the Prior Art

Hitherto, three to five kinds of handles or levers have been utilized for maneuvering ships having two sets of Z-type propelling means. These handles or levers require complicated handling accomplished only by a skilled helmsman.

Therefore, a demand has existed to provide a single handle for maneuvering at least two sets of Z-type propelling means to provide the ship advancing direction equal to the handle direction, and ship speed proportional to the inclination angle of the handle.

U.S. Pat. No. 3,976,023 (commonly assigned) discloses such apparatus which comprises a maneuvering handle adapted to be inclined at any angle about a predetermined point. The ahead-astern switching transmitting device is adapted to issue electric signals for switching "ahead" and "astern" movement of the ship in accordance with the travel distance of the handle in one of two components, the sum constituting the angle of inclination of said handle. Steering transmitting means are adapted to issue signals for steering the ship to the port or starboard side in accordance with the travel distance of the handle in another component direction.

However, this system has a drawbacks in terms of the ship speed and the travel distance of the handle. That is, proportional relationship between the inclination angle of the handle and the ship speed would not be obtainable in all regions of use.

Therefore, the system for providing the ship speed in proportion to handle inclination amount is required for easy maneuverability. Further, according to conventional apparatuses, complicated electric circuits are provided and therefore, skilled techniques and long time are required to provide or to repair the same. Furthermore, the electric circuit limits the handle operation and therefore, mechanical means which functions instead of the one electric circuit is required to reduce or minimize the complicated electric circuit.

Referring to FIG. 7 of the prior art U.S. Pat. No. 3,976,023 it can be seen that at the positions to the extreme left and right on the neutral X axis the handle would be inclined to the extreme left or right positions but the speed is not correspondingly the greatest at those positions. For example, in the extreme leftward inclination maximum speed to port would be achieved in the upper right hand corner of that figure with both the propellors directed to the starboard side. The same would be true for speed to starboard. Hence, in this prior art system an area of settings exists where there is no corresponding relationship between ship speed and inclination angle of the handle. Then, areas exist in two triangular areas having an apex at the 0—0 neutral point in FIG. 7 and extending outward diagonally to the extreme corners of the chart, i.e. to the full port starboard, ahead and astern positions.

SUMMARY OF THE INVENTION

It is therefore, an object of this invention to overcome the above-mentioned drawbacks and to provide an improved apparatus for maneuvering a ship, particularly a ship having Z-type propelling means.

Another object of this invention is to provide the apparatus in which ship speed has a proportional relationship with the inclination angle of the maneuvering handle while coinciding the ship direction with the rotational direction of the handle.

These objects are attained in accordance with the present invention by providing a generally cylindrical rotation frame rotatably supported by a stationary frame, a rotation shaft disposed along the diametrical direction of the rotation frame, and a maneuvering handle positioned at the approximately central portion of the rotation shaft. The lower end of the maneuvering handle is connected to the rotation shaft. The rotation shaft is rotated about its axis by the pivotal movement of the handle. Furthermore, a hollow shaft is rotatably disposed coaxial with the rotation frame. The hollow shaft is provided with first and second central gears. A central shaft rotatably disposed in the hollow shaft has one end provided with an ahead-astern changing gear and the other end provided with an arm member. The central shaft further provides a loose gear and a bevel gear both being freely rotatable thereabout, and the arm member rotatably supports an intermediate shaft having one end provided with a first intermediate gear and the other end provided with a second intermediate gear. The loose gear is in meshing engagement with the first intermediate gear and the second central gear is meshed with the second intermediate gear.

Furthermore, a steering gear is fixedly secured to the rotation frame and is coaxial with the central shaft. The steering gear and the ahead-astern gear are connected to the steering and ahead-astern oscillators, respectively.

The pivotal movement of the handle provides the rotation of the rotation shaft to rotate the ahead-astern gear through bevel gear, loose gear, first intermediate gear, second intermediate gear, and the central shaft, and the rotational movement of the handle provides the rotation of the steering gear through the rotation frame. Moreover, a reversal gear is provided to prevent the central shaft from being rotated together with the rotation of the rotation frame. The reversal gear is rotated together with the steering gear to rotate the first central gear, the hollow shaft and arm member to thereby rotate the central shaft to the direction opposite to the rotational direction of the rotation frame and the rotation angle of the central shaft is equal to that of the rotation frame.

These and other objects of this invention and the above summary will be explained in detail with respect to the description of the drawings and the preferred embodiment which follows.

DETAILED DESCRIPTION OF THE INVENTION

Figure 1:
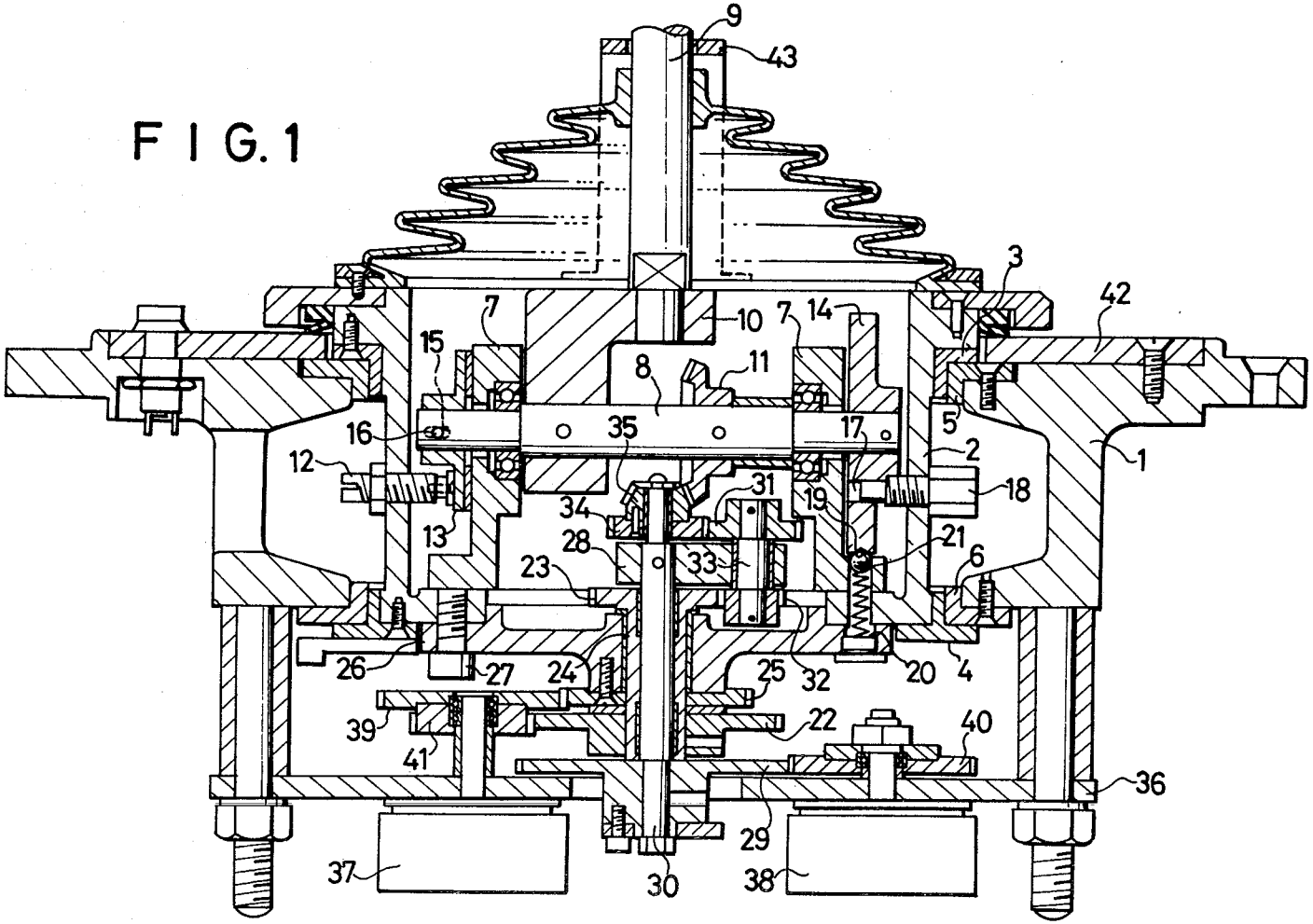
FIG. 1 shows a cross-sectional elevation of maneuvering apparatus according to this invention.

Referring now to the drawings, and initially to FIG. 1, a cylindrical rotation frame 2 is rotatably supported with respect to a stationary frame 1 by relative sliding engagement between upper and lower slide rings 3, 4 and upper and lower guide rings 5, 6, respectively. The slide rings 3, 4 are fixedly secured to an outer peripheral end portions of the rotation frame 2, and the guide rings 5, 6 are fixedly secured to inner peripheral end portions of the stationary frame 1.

A rotation shaft 8 is rotatably supported by supporting frames 7, 7 confronting with each other and disposed in the rotation frame 2. The shaft 8 is connected to an attaching member 10 which centrally disposes a maneuvering handle 9 with respect to the rotation frame 2. The shaft 8 is provided with a bevel gear 11, a rotation resistant member 13 and a rotation restrictor disc 14. The rotation resistant member 13 is in pressing contact with the supporting frame 7 by an adjusting screw 12 threadingly engaged with the frame 2 in order to apply resistive force against the rotation of the shaft 8 relative to the supporting frames 7. The rotation resistant member 13 is provided with a slide key 16 engaging a key way 15 formed in the rotation shaft 8 along the axial direction thereof, to thereby permit rightward and leftward movement of member 13. Also, frictional wear occurring between the supporting frame 7 and the rotation resistant member 13 is compensated.

The rotation restrictor disc 14 is formed with an arcuate groove 17 whose imaginary center is the axis of the rotation shaft 8. The arcuate groove 17 receives a tip end of a stopper 18 threadingly engaged with the rotation frame 2, so that the rotation of the shaft 8 about its axis is restricted upon abutment between the stopper end and the end surfaces of the arcuate groove 17. The disc 14 is also formed with a notch 19 at an outer peripheral surface thereof adapted to receive a ball 21 upwardly urged by the biasing force of a spring 20. The notch position is determined to receive the ball 21 therein when the maneuvering handle 9 is vertically positioned with respect to an indication plate 42 disposed on the stationary frame 1.

With this structure, the maneuvering handle 9 is pivotted about the rotation shaft 8 via the attaching member 10 within the limited range defined gy the arcuate groove 17. However, the pivotal movement of the handle 9 is subject to a resistive force because of the friction caused by the surface engagement between the supporting frame 7 and the rotation resistant member 13. The handle is latched with suitable force upon engagement between the notch 19 and the ball 21 when the handle is positioned vertically relative to the indication board 42.

A hollow shaft 24 is supported coaxial with the rotation frame 2 by a bottom plate 26 fixedly secured to the bottom portion of the rotation frame 2 by means of a bolt 27. The hollow shaft 24 has a first central gear 22 at a lower end portion thereof, and a second central gear 23 at the upper end portion thereof. The bottom plate 26 is provided with a steering gear 25 at the lower end portion thereof.

A central shaft 30 extending into the hollow shaft 24 is rotatable with respect thereto. The central shaft has an upper portion provided with an arm 28 and has a lower end provided with an ahead-astern changing gear 29. The arm 28 rotatably supports at one end thereof an intermediate shaft 33 having an upper end provided with a first intermediate gear 31 and lower end provided with a second intermediate gear 32. The central shaft 30 has an upper end provided with a loose gear 34 and a driven bevel gear 35 integrally connected thereto. The loose gear 34 and the driven bevel gear 35 are freely rotatable about the shaft 30 and the latter is meshed with the bevel gear 11. The first and the second intermediate gears 31 and 32 are meshed with the loose gear 34 and the second central gear 23, respectively.

With this structure, pivotal movement of the maneuvering handle 9 rotates the rotation shaft 8 about its axis, which in turn rotates the loose gear 34 because of the meshing engagement between the bevel gears 11 and 35 to transmit the rotation to the first intermediate gear 31. In this case, since the intermediate shaft 33 is subject to loading because of the meshing engagement between the second intermediate gear 32 and the first central gear 23 and between the gears 25, 39, 41, 22, 29, 40 mentioned later, the rotation of the intermediate shaft 33 relative to the arm 28 is prevented. Hence, the first intermediate gear 31 permits orbital motion around the loose gear 34 (that is, the gear 31 functions as a planetary gear), which in turn rotates the central shaft 30 about its axis through the arm 28.

Also, shown in FIG. 1, are a steering oscillator 37 such as a potentiometer and an ahead and astern oscillator 38, each fixed to a base plate 36 attached to the stationary frame 1. The oscillator 37 is actuated by the rotation degree of a steering drive gear 39 meshed with the steering gear 25, to transform the rotation degree of the rotation frame 2 caused by the rotation of the handle 9 into an electric signal. The oscillator 38 is actuated by a rotation degree of an head-astern drive gear 40 meshed with the ahead-astern changing gear 29, to thus transform the pivot angle amount of the handle 9 into an electric signal.

The steering drive gear 39 is integrally and coaxially provided with a reversal gear 41 meshed with the first central gear 22 in order to prevent the central shaft 30 from being rotated by the rotation of the rotation frame 2. More specifically, when the rotation frame 2 is rotated relative to the stationary frame 1 by the rotation of the handle 9 about its axis, the reversal gear 41 is rotated together with the steering drive gear 39 to rotate the first central gear 22 toward the direction equal to the rotation frame 22. This will rotate the hollow shaft 24. In this case, since the intermediate shaft 33 is subject to a load because of the meshing engagement between gears 31, 34 and 35, the second intermediate gear 32 permits orbital motion around the second central gear 23, to thereby rotate the central shaft 30 via the arm 28 to the direction opposite to the rotational direction of the rotation frame 2. When the rotation angle of the shaft 30 is equal to that of the rotation frame 2, the rotation of the rotation frame 2 does not affect the rotation of the ahead-astern drive gear 40.

Figure 2:
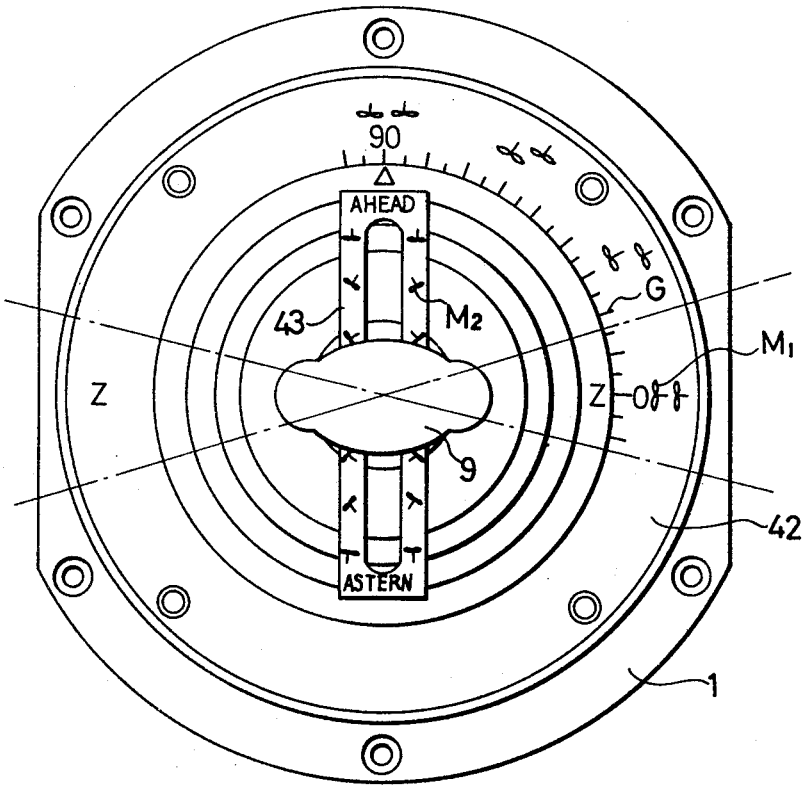
FIG. 2 shows a plan view showing a maneuvering apparatus according to this invention.

As shown in FIGS. 1 and 2, an annular indication board 42 is fixedly mounted on the stationary frame 1. The board 42 provides indication marks $M_1$ which show thrusting directions of the two propellers and angle scale G. Also, a slotted arcuate indication 43 is disposed on the rotation frame 2. The indication 43 provides marks $M_2$ which show thrusting directions of the propellers.

Figure 3:
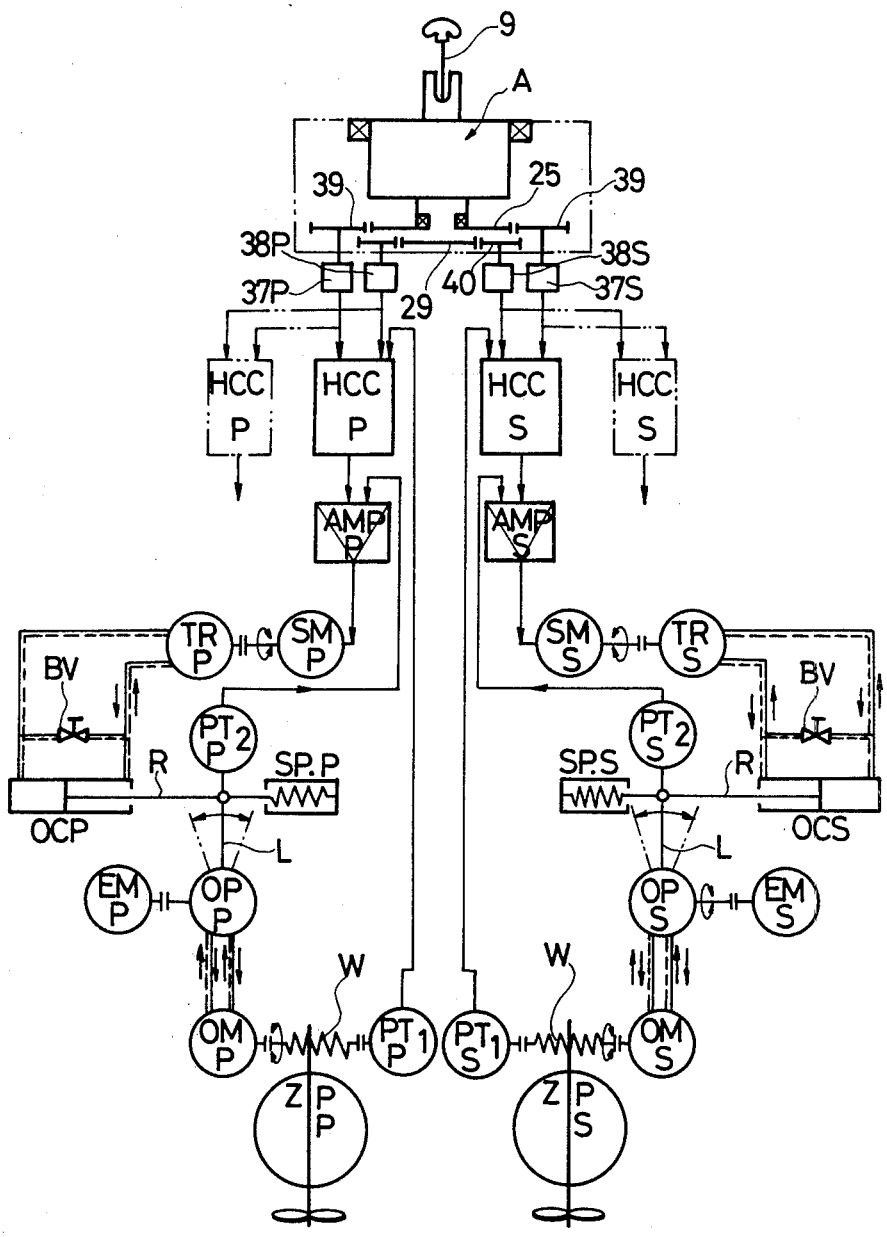
FIG. 3 shows a schematic block diagram incorporating the maneuvering apparatus according to the present invention.

FIG. 3 shows a block diagram incorporating the maneuvering apparatus A mentioned above, wherein like parts and components are designated by the same reference numerals as those shown in FIGS. 1 and 2. The ahead-astern gear 29 is connected to ahead-astern oscillators 38P and 38S each controlling the port side and starboard propellers ZPP and ZPS respectively. The oscillators 38P and 38S generate signals to direct the propeller shafts of ZPP and ZPS to the direction opposite with same angle with each other with respect to the central symmetrical line of the boat in response to pivot angle of the maneuvering handle 9. On the other hand, the steering gear 25 is connected to steering oscillators 37P and 37S each controlling the port side and starboard propellers ZPP and ZPS respectively. These oscillators 37P and 37S generate signals to direct the propeller shaft of the ZPP by the angle equal and to the direction equal to the moving angle and moving direction of the propeller shaft of ZPS in response to the rotation degree of the handle 9. It should be noted that abbreviations "P" and "S" simply designate port side and starboard, respectively, and for the simplicity, the following description omits these abbreviations but it should be understood that the corresponding parts perform the same function with each other if "P" or "S" is omitted.

The steering oscillator 37 and the ahead-astern oscillator 38 are connected to a synthesizing circuit HCC connected to an amplifying circuit AMP. The synthesizing circuit HCC operates steering signal and the ahead-astern signal fed from the steering oscillator 37 and the ahead-astern oscillator 38, respectively and determines thrusting or turning directions of port side and starboard propellers ZPP and ZPS. Such an operation signal is fed to the amplifying circuit AMP. The amplifying circuit AMP actuates a sleeve motor SM in response to the electric signal supplied from the synthesizing circuit HCC to actuate a reversible trochoid pump TR connected to the sleeve motor SM, to thus extend or retract a piston rod R of an oil cylinder OC. The piston rod R is connected to an operation lever L of a variable-capacity-type oil pump OP actuated by an electric motor EM. The inclination angle of the operation lever L determines the oil discharge or intake amount of the variable-capacity-type oil pump OP to control rotation of constant-capacity-type oil pressure motor OM, to thus control the rotation of a worm shaft W adapted to turn the thrusting direction of the propeller ZP.

The worm shaft is provided with a following type oscillator $PT_1$ to perform "feed-back", namely, the rotation number of the worm shaft W (corresponding to turning angle of the propeller shaft) is detected by the oscillator $PT_1$. The rotation number is transformed into an electric signal and the signal is fed to the synthesizing circuit HCC as an input signal. The synthesizing circuit HCC compares this input electric signal with the output signal, and supplies an output signal into the amplifying circuit when the input signal is equal to the output signal.

A neutral following oscillator $PT_2$ is connected between the operation lever L and the amplifying circuit AMP. The oscillator $PT_2$ transforms the inclination angle of the lever L into an electric signal and achieves feed-back operation, wherein the electric signal supplied from the synthesizing circuit HCC to the amplifying circuit AMP is compared with the electric signal supplied from the neutral following oscillator $PT_2$ to the amplifying circuit AMP. In case the electric signal value of the oscillator $PT_2$ is larger than the signal value from the maneuvering device A, the electric signal to be supplied from the synthesizing circuit HCC to the sleeve motor SM is interrupted, and simultaneously, the neutral following oscillator $PT_2$ supplies electric signal to the sleeve motor SM to return the operation lever L to its neutral position. When the operation lever L is returned to its neutral position, the electric signal supplied from the following oscillator $PT_1$ connected to the worm shaft W becomes equal to the electric signal supplied from the maneuvering apparatus A. The propelling means ZP is then maintained in its position by the instruction from the maneuvering apparatus and propelling means ZP waits next instruction from the maneuvering apparatus A.

A spring SP is connected at the top end of the piston rod R to urge the same to thereby urge the operation lever L toward its neutral position. Furthermore, a valve BV is provided at a bypass passage of the oil cylinder OC. The manual operation of the level L can be achieved by opening the valve BV to thereby render a piston of the oil cylinder OC freely reciprocable. Furthermore, the synthesizing circuit can be provided in parallel as shown by chain lines in order to centralize at least three propelling means by a single handle 9.

The operation of the maneuvering apparatus, thus constructed will now be described.

Figure 4:
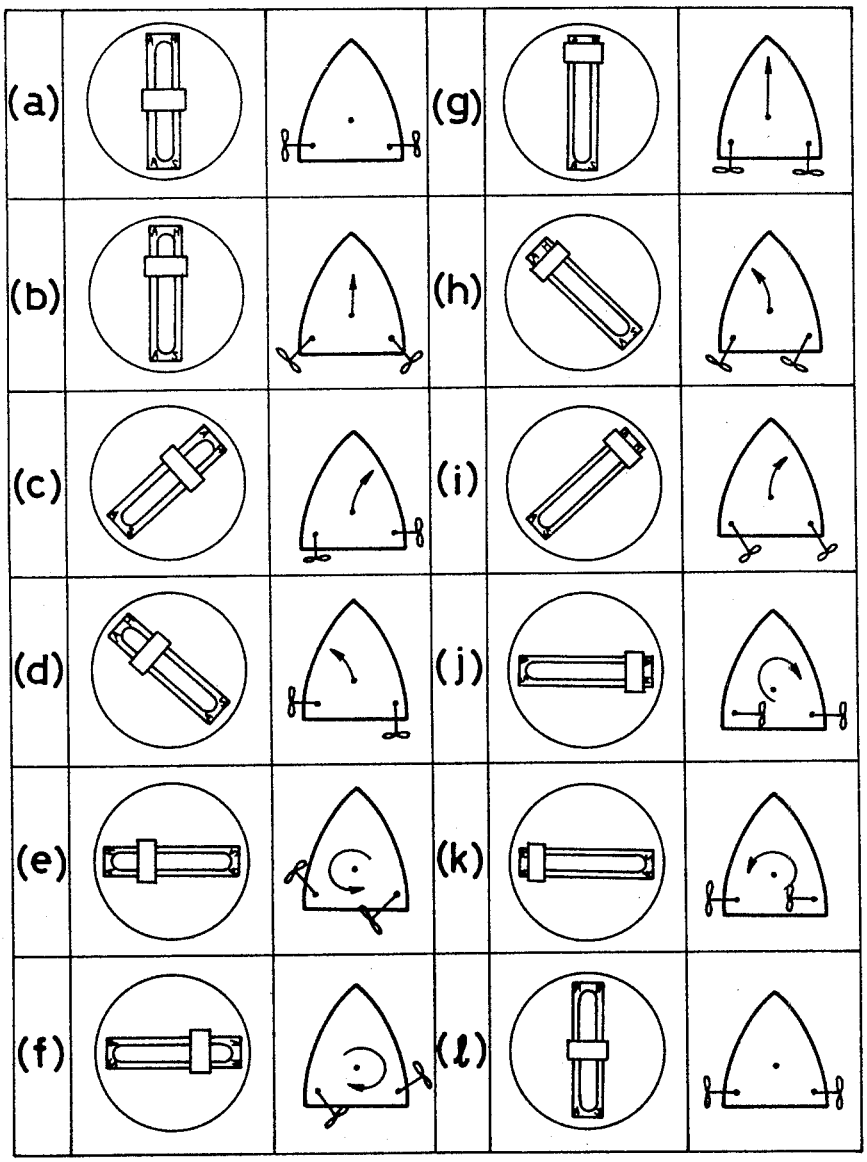
FIGS. 4, 4*a* are explanatory illustrations showing the relationship between handle position (rotation degree and inclination angle) and the thrusting direction of propellers (direction of boat) according to this invention.
Figure 4A:
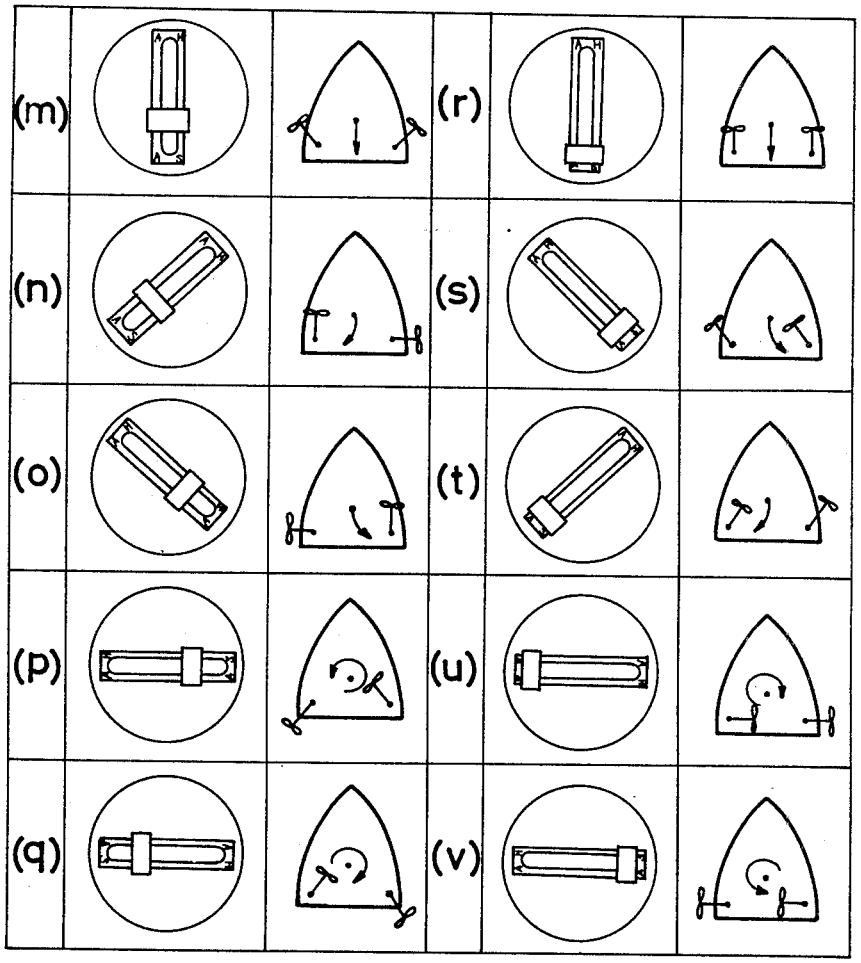

In FIGS. 1 and 2, the maneuvering handle 9 is upstanding in which two propellers are directed toward opposite directions with each other as shown by (a) and (l) in FIGS. 4, 4*a* so that thrusting force of the propellers cancel each other, whereby the boat is maintained in its position.

Then when the maneuvering handle is slanted frontwardly the rotation shaft 8 is rotated via the attaching member 10 to rotate the loose gear 34 because of the meshing engagement between the level gears 11 and 35. In this case, since the first central gear 22 connected to the hollow shaft 24 is in a stationary relationship with the rotation frame 2 through the reversal gear 41, steering drive gear 39, and the steering gear 25, rotation of the intermediate shaft 33 about its axis is prevented by the engagement between the second central gear 23 and the second intermediate gear 32. Therefore the first intermediate gear 31 is revolved around the loose gear 34 to thus revolve the intermediate shaft 33 around the hollow shaft 24, whereby the central shaft 30 is rotated about its axis through the arm 28. By the rotation of the central shaft 30, the ahead-astern drive gear 40 is rotated by the rotation of the ahead-astern gear 29 to thereby actuate the ahead-astern oscillator 38 to thus generate an electric signal in response to the inclination angle (pivotal angle) of the maneuvering handle 9. (Inclination implies up and down movement of the handle 9 in a slot of the arcuate board 43 shown in FIG. 2). In this case, electric signal is not generated in the steering oscillator 37 because of no rotation of the steering drive gear 39. By the electric signal from the ahead-astern oscillator 38, the thrusting directions of the propellers are changed as shown in diagrams (b) or (g) of FIG. 4 to thus straightly move the boat. It should be noted that the ship speed is the fastest when the inclination angle of the handle 9 becomes the greatest as shown in FIG. 4(*g*) or 4*a*(*r*) in case of straight travel of the boat.

As is apparent from the above description, if the maneuvering handle 9 is rearwardly inclined, the ship moves rearwardly by the change of thrusting directions of the propellers shown in FIG. 4*a*(*m*).

When the maneuvering handle 9 is rotated about its axis relative to the stationary frame 1, but maintaining its inclination angle as shown by FIG. 4(*b*) or (*g*), the steering gear 25 is rotated to rotate the steering drive gear 39, to thus actuate the steering oscillator 37. In this case, since the central shaft 30 is prevented from being rotated together with the rotation of the rotation frame 2 because of the employment of reversal gear 41, the ahead-astern oscillator 41 is not actuated by the rotation of the ahead-astern drive gear 40, but is maintained its position shown by the state in FIG. 4(*b*) or (*g*).

That is, if the handle 9 is rotated as shown by FIGS. 4(*c*), (*d*), (*e*), (*f*) with maintaining its inclination angle, shown by FIG. 4(*b*) an angle defined by the intersection between the propeller shafts is maintained in being equal with each other because of no further actuation of the ahead-astern oscillator 38. The two propeller shafts are turned toward the equal direction with equal angle with each other by the actuation of the steering oscillator 37.

Similarly, if the handle 9 is rotated as shown by FIG. 4(*h*), (*i*), (*j*), (*k*) while maintaining its inclination angle shown by FIG. 4(*g*), the propeller shafts are in parallel with each other because of no further actuation of the ahead-astern oscillator 38, but the turning angle and the turning directions of the propeller shafts are equal by the actuation of the steering oscillator 37.

The electric signal from the steering oscillator 37 and the electric signal from the ahead-astern oscillator 38, whose signal is equal to that generated during the state in FIG. 4(*b*) or (*g*) are supplied into the synthesizing circuit HCC. The synthesizing circuit HCC operates on signals therefor to supply the same into the amplifying circuit, to thus turn the propeller shafts as mentioned above. Therefore, the ship is moved toward the rotational direction of the maneuvering handle with the ship speed being in proportion with the inclination angle of the maneuvering handle 9.

Furthermore, according to the present invention, the maneuvering handle is provided with an interlocking mechanism (not shown) to maintain a neutral state as shown by FIG. 4(*a*) or (*l*) regardless of the rotation of the rotation frame 2 in case the inclination angle of the handle 9 is within 5°. That is, the cynthesizing circuit HCC incorporates a circuit element for interrupting the electric signal from the steering oscillator 37 by the electric signal of the ahead-astern oscillator 38 at the inclination of the handle 9 within 5° (this angle is adjustable in this invention).

According to the present invention, if the handle 9 is rotated from the position in FIGS. 4(*g*) to 4(*j*), the ship is turned toward right, and if the handle 9 is rotated from the position in FIG. 4*a*(*r*) to FIG. 4*a*(*v*), the ship is turned toward left. Although the position or inclination angle of the handle 9 shown by FIG. 4(*j*) is the same as that shown by FIG. 4*a*(*v*), the ship is directed in opposite directions, and therefore, the operator may be confused, if intermediate operation is required. (though ahead mark AH and astern mark AS are shown in the arcuate board 43.)

Such movement is inevitable in the mechanism which permits 360° turning of the two propeller shafts and circular movement of the maneuvering handle 9. The reason is as follows.

Figure 5A:
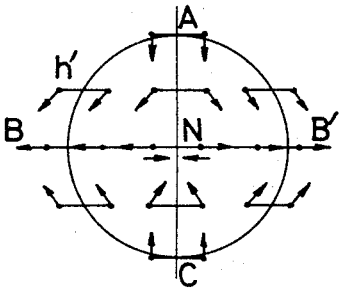
FIGS. 5(*a*) and 5(*b*) are explanatory illustrations showing the relationship between the handle position and the thrusting direction of propellers.
Figure 5B:
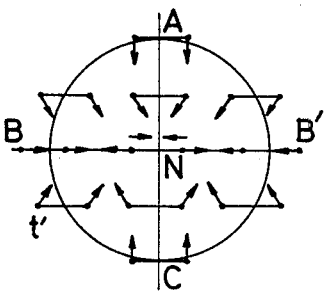
Figure 6A:
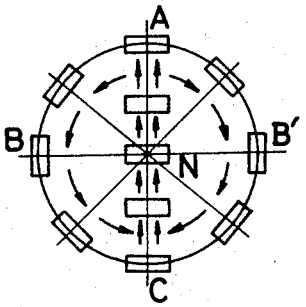
FIGS. 6(*a*) and 6(*b*) are explanatory illustrations showing the examples of the movement or travel of the handle.
Figure 6B:
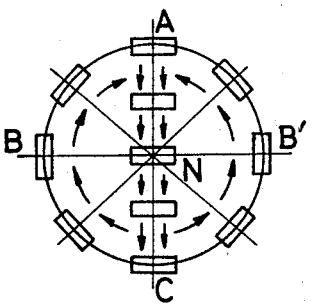

As shown in FIG. 6(*a*), if the maneuvering handle 9 is moved in a sequence N→A→B→C→N, or N→A→B'→C→N, the propelling means are directed as shown by FIG. 5(*a*). Further, as shown in FIG. 6(*b*) if the maneuvering handle 9 is moved in a sequence N→C→B→A→N or N→C→B'→A→N, the propelling means are directed as shown by FIG. 5(*b*). In FIG. 5(*a*) at the upper half portion of the circle, the ship can be directed toward the rotational direction of the handle 9, for example, the position (h') corresponds to position h of FIG. 4, however, at the lower half portion of the circle except for line N–C, the boat is turned toward the rotational direction opposite to the handle 9.

Figure 7:
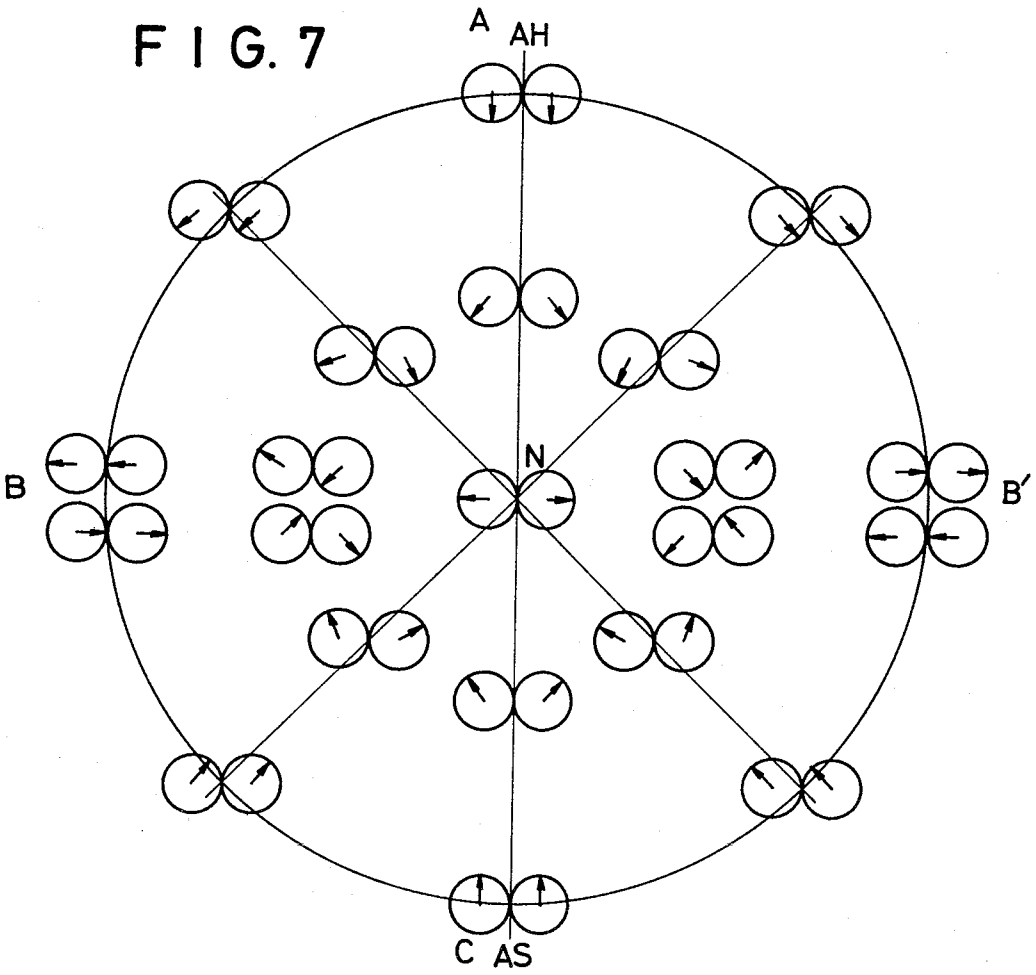
FIG. 7 is an explanatory illustration showing the relationship between the handle and thrusting directions of propellers according to the present invention.

Similarly, the FIG. 5(*b*), at the lower half portion of the circle, the ship can be directed toward the rotational direction of the handle 9, for example, the position (t') corresponds to the position (t) of FIG. 4. However, at the upper half portion of the circle (except for line N–A), the ship is directed toward the rotational direction opposite to the handle 9. Therefore, FIG. 4 and FIG. 7 are the combination of the upper half portion of FIG. 5(*a*) and the lower half portion of FIG. 5(*b*).

For this reason, the thrusting directions of the propellers ZP are opposite with each other even if the inclination angle of the handle 9 is equal with each other at the portion defined by the line B–B' (though the AH, AS marks of the board 43 are different with each other), which may incur danger and complex maneuvering. That is, if the handle 9 passes the line B–B' (except the handle operation along the line A N C), the propeller turning loses its continuity, so that the ship may be turned in an unexpected direction.

With the above in mind, according to the present invention, an overlapping zone Z is provided as shown in FIG. 2, the overlapping angle of which is controllable. That is, if the handle 9 is moved in a sequence N→A→B→C, or N→A→B'→C as shown by FIG. 6(*a*), thrusting direction change of the propellers of FIG. 5(*a*) at the overlapping zone. If the handle passes over the overlapping zone Z, the thrusting directional change of the propellers is made according to that achieved in lower half portions of FIG. 5(*b*).

Similarly, if the handle 9 is moved in a sequence N→C→B→A or N→C→B'→A as shown by FIG. 6(*b*), thrusting directional change of the propellers is made according to that achieved in the lower half portion of FIG. 5(*b*) at the overlapping zone. If the handle passes over the zone Z, the thrusting directional change of the propellers is made according to that achieved in the upper half portion of FIG. 5(*a*).

As mentioned above, according to the present invention, the inclination angle and rotation angle of the maneuvering handle are independently and mechanically transmitted to the ahead-astern oscillator and steering oscillator, respectively, and therefore electric vector operation to detect these angles can be reduced, to thus provide simple electric components for repair if the circuit breaks down.

It is apparent that modifications of this invention can be made without departing from the essential scope of this invention.

What is claimed is:

1. Apparatus for maneuvering a ship having Z-type propeller structure comprising;

a generally cylindrical rotation frame rotatably supported by a stationary frame, a rotation shaft disposed along a diametrical direction of the rotation frame;

a maneuvering handle positioned at the approximately central portion of the rotation shaft, the lower end of the maneuvering handle connected to the rotation shaft and the rotation shaft being rotated about its axis by the pivotal movement of the handle;

transducer means for converting movement of the handle into corresponding movement of said Z-type propeller structure;

a first gear transmission mechanism for transmitting the rotation of the rotation frame to the transducer means to actuate the same to thus generate signals to direct propeller shafts of the Z-type propeller structure by an equal angle and to the direction equal with each other; and a second gear transmission mechanism for transmitting the pivotal movement of the handle to the transducer means to actuate the same to thus generate signals to direct the propeller shafts of the Z-type propeller structure by an equal angle and to the direction opposite with each other.

2. The apparatus of claim 1, wherein said transducer means comprises a steering oscillator connected to said first gear transmission mechanism and an ahead-astern oscillator connected to said second gear transmission mechanism.

3. The apparatus of claim 2, wherein said first gear transmission mechanism comprises a steering gear fixedly secured to and disposed coaxial with the rotation frame, and a steering drive gear meshed with the steering gear, said steering drive gear being connected to said steering oscillator.

4. The apparatus of claim 2, wherein said second gear transmission mechanism comprises a hollow shaft provided with first and second central gears; and a central shaft rotatably disposed inside said hollow shaft and having one end provided with an ahead-astern gear and the other end provided with an arm member, said central shaft further provided with a loose gear and a bevel gear both being freely rotatably thereabout, said arm member rotatably supporting an intermediate shaft having one end provided with a first intermediate gear and the other end provided with a second intermediate gear, wherein said loose gear is in meshing engagement with the first intermediate gear and the second central gear meshes with the second intermediate gear, said ahead-astern gear being meshed with an ahead-astern drive gear connected to said ahead-astern oscillator.

5. The apparatus of claim 4, wherein pivotal movement of the handle provides the rotation of the rotation shaft to rotate the ahead-astern gear through the bevel gear, loose gear, first intermediate gear, second intermediate gear, and the central shaft.

6. The apparatus of claim 3, wherein the rotational movement of the handle provides the rotation of the steering gear through the rotation frame.

7. The apparatus of claim 4, further comprising a reversal gear disposed between said first and second gear transmission mechanisms, said reversal gear preventing the central shaft from being rotated together with the rotation of the rotation frame, said reversal gear rotated together with the steering gear to rotate the first central gear, the hollow shaft and the arm member to thereby rotate the central shaft in a direction opposite to the rotational direction of the rotation frame and wherein the rotation angle of the central shaft is equal to that of the rotation frame.

8. The apparatus of claim 2, wherein said steering oscillator comprises port and starboard steering oscillators and said ahead-astern oscillator comprises port and starboard ahead-astern oscillators.

9. The apparatus of claim 8, further comprising a first synthesizing circuit receiving the outputs of said port steering oscillator and said port ahead-astern oscillator and a second synthesizing circuit receiving the outputs of said starboard steering oscillator and said starboard ahead-astern oscillator, said first and second synthesizing circuits determining the turning direction of port and starboard side propellers of said Z-type structure.

10. The apparatus of claim 9, further comprising port and starboard amplifier means coupled respectively to said first and second synthesizer circuits, respective port and starboard sleeve motor means receiving the outputs of said port and starboard amplifier means and, port and starboard hydraulic means responsive to said respective sleeve motor means for moving said propellers in a desired turning direction.

11. The apparatus of claim 10, wherein each of said hydraulic circuit means comprises a trochoid pump coupled to said sleeve motor, a piston rod extendable by pump action and coupled to an operating lever of a variable capacity oil pump, a constant capacity oil pressure motor having a rotation rate controlled by said variable capacity oil pump and output means associated with said oil pressure motor to turn a respective propeller.

12. The apparatus of claims 10 or 11, further comprising first feed-back means responsive to the turning angle of said port and starboard propellers to provide an electric feed-back signal to said first and second synthesizing circuits.

13. The apparatus of claims 10 or 11, further comprising second feedback means responsive to said hydraulic means for providing a second electric feedback signal to said amplifier means indicative of the actuation position of said hydraulic means, whereby second electric feedback signal is compared with the output signal from the synthesizing circuit and when said second feedback signal is larger than the output signal from the synthesizing circuit, the output signal to said sleeve motor is interrupted and said second feedback means delivering a signal to said sleeve motor to return said hydraulic means to a neutral position.

14. The apparatus of claim 11, wherein said output means responsive to said oil pressure motor comprises a worm gear and feedback means responsive to rotation of said worm gear to supply a feedback signal to said synthesizing circuit indicative of propeller turning position.

* * * * *